US006496097B2

(12) United States Patent
Frank

(10) Patent No.: US 6,496,097 B2
(45) **Date of Patent: *Dec. 17, 2002**

(54) DUAL CIRCUIT TEMPERATURE CONTROLLED SWITCH

(75) Inventor: James P. Frank, Rock Falls, IL (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 58 days.

(21) Appl. No.: 09/400,172

(22) Filed: Sep. 21, 1999

(65) Prior Publication Data

US 2002/0011917 A1 Jan. 31, 2002

(51) Int. Cl.[7] ..... H01H 37/38; H01H 37/42; H01H 37/12; G05D 23/275

(52) U.S. Cl. ..... 337/323; 337/320; 337/306; 337/309; 236/93 A; 324/417; 269/513; 269/515

(58) Field of Search ..... 337/337, 365, 337/306, 309, 311, 318–323, 327, 330, 332, 382, 383, 390, 393, 394, 396, 398, 400, 417, 114–119, 333, 343, 362, 37–41, 51–53; 236/93 A, 93 R; 324/417; D10/50; 219/511, 513, 515; 200/406, 407, 448, 460, 461; 29/623

(56) References Cited

U.S. PATENT DOCUMENTS

| | | | | | |
|---|---|---|---|---|---|
| 3,139,500 | A | * | 6/1964 | Fallon et al. | 200/138 |
| 3,189,703 | A | | 6/1965 | Chapin et al. | |
| 3,530,419 | A | * | 9/1970 | Hire | 337/365 |
| 3,617,971 | A | * | 11/1971 | Ellenberger | 337/107 |
| 3,633,143 | A | * | 1/1972 | Yoshimura | 335/145 |
| 3,648,214 | A | * | 3/1972 | Slonneger | 337/311 |
| 3,648,478 | A | | 3/1972 | Linstromberg | |
| 3,899,765 | A | * | 8/1975 | Daigneault, Jr. | 337/386 |
| 4,163,129 | A | * | 7/1979 | Rossi et al. | 200/81.4 |
| 4,166,268 | A | * | 8/1979 | Beck | 337/309 |
| 4,206,344 | A | * | 6/1980 | Fischer et al. | 219/507 |
| 4,224,488 | A | * | 9/1980 | Rossi | 200/67 A |
| 4,317,100 | A | * | 2/1982 | Boulanger et al. | 337/347 |
| 4,325,046 | A | * | 4/1982 | Burch | 337/56 |
| 4,339,738 | A | * | 7/1982 | Colavecchio | 337/354 |
| 4,490,708 | A | | 12/1984 | Thompson et al. | |
| 4,510,479 | A | * | 4/1985 | Merchant | 337/91 |
| 4,510,480 | A | * | 4/1985 | Rossi et al. | 337/321 |
| 4,615,179 | A | | 10/1986 | Chiu et al. | |
| 5,142,261 | A | | 8/1992 | Fuller et al. | |
| 5,191,310 | A | * | 3/1993 | Obermann et al. | 337/105 |
| 5,467,523 | A | | 11/1995 | Seaman | |
| 5,585,774 | A | | 12/1996 | Bennett | |
| 5,790,010 | A | * | 8/1998 | Schwab | 200/407 |

FOREIGN PATENT DOCUMENTS

| | | | | | |
|---|---|---|---|---|---|
| DE | 1765488 B | * | 7/1975 | | H01H/37/12 |
| GB | 1395312 A | * | 5/1975 | | H01H/37/00 |
| JP | 3-201337 A | * | 9/1991 | | H01H/37/54 |

* cited by examiner

*Primary Examiner*—Anatoly Vortman
(74) *Attorney, Agent, or Firm*—Karl Vick, Esq.; Damian Wasserbauer, Esq.; Armstrong Teasdale LLP

(57) ABSTRACT

A temperature responsive switch includes a housing, an actuator arm for movement in response to temperature conditions, a movable contact, and an adjustable contact connected to a auxiliary terminal for completing an auxiliary circuit. The movable contact engages and disengages the auxiliary contact to cycle a first element on and off in response to exceedingly large temperature swings a specified location, and also engages a stationary contact to complete a main circuit and cycle a different electrical element on and off in response to relatively modest changes in temperature changes at the same specified location.

23 Claims, 4 Drawing Sheets

DUAL CIRCUIT TEMPERATURE CONTROLLED SWITCH

BACKGROUND OF THE INVENTION

This invention relates generally to condition-responsive switches and, more particularly, to a switch for controlling more than one circuit in response to a specified temperature reference point.

Switches that are responsive to temperature changes, commonly known as thermostats or cold controls, are widely used in refrigeration systems, and typically regulate the switching cycle of a compressor in response to the temperature of the air contained at a remote location. When the temperature exceeds a certain "turn-on" point, the switch contacts are closed and the compressor is switched on to cool the air. When the temperature drops below a certain "turn-off" point, the switch contacts are opened and the compressor is switched off. Thus, the thermostat opens and closes a main electrical circuit in response to temperature changes at a specified location.

Sometimes, however, it is desirable to also control an auxiliary circuit in response to changes in temperature at the same location that stimulates the main circuit. Thus, extreme temperature conditions, or fault conditions in the main circuit, may be corrected by or identified by auxiliary elements connected to the auxiliary circuit.

Accordingly, it would be desirable to provide a condition responsive switch capable of providing temperature control of both a main circuit and an auxiliary circuit.

BRIEF SUMMARY OF THE INVENTION

In an exemplary embodiment of the invention, a condition responsive electric switch includes a housing, an actuator arm, a movable electrical contact, and an adjustable electrical contact for completing an auxiliary circuit. The actuator arm is mounted within the housing for pivotal movement that moves the movable contact and opens and closes the movable and adjustable electrical contacts to complete or break an auxiliary circuit through the switch in response to environmental conditions outside of the housing, such as the temperature of a specified reference point.

When the reference temperature falls, refrigerant inside a bellows and in fluid communication with the temperature reference point contracts and moves the actuator arm, which causes the movable contact to engage the adjustable contact and complete an auxiliary circuit. As the temperature of the reference point rises, the refrigerant expands in the bellows and causes the actuator arm to move and disengage the movable contact from the adjustable contact. Thus, the auxiliary circuit can be used to avoid excessively cold temperatures at the temperature reference point, by, for example, switching on a heating element through the auxiliary circuit.

The position of the adjustable contact relative to the movable contact is adjustable to calibrate the sensitivity of the auxiliary circuit to movement of the actuator arm. Thus, the auxiliary contact may be moved closer to or farther away from the movable contact to vary the required temperature change, or differential in the reference point temperature that cause the movable contact and the auxiliary contact to engage, thereby closing the auxiliary circuit. The smaller the separation of the movable contact and the auxiliary contact, the smaller the temperature differential at the reference point that will close the contacts.

DETAILED DESCRIPTION OF THE INVENTION

Figure 1:
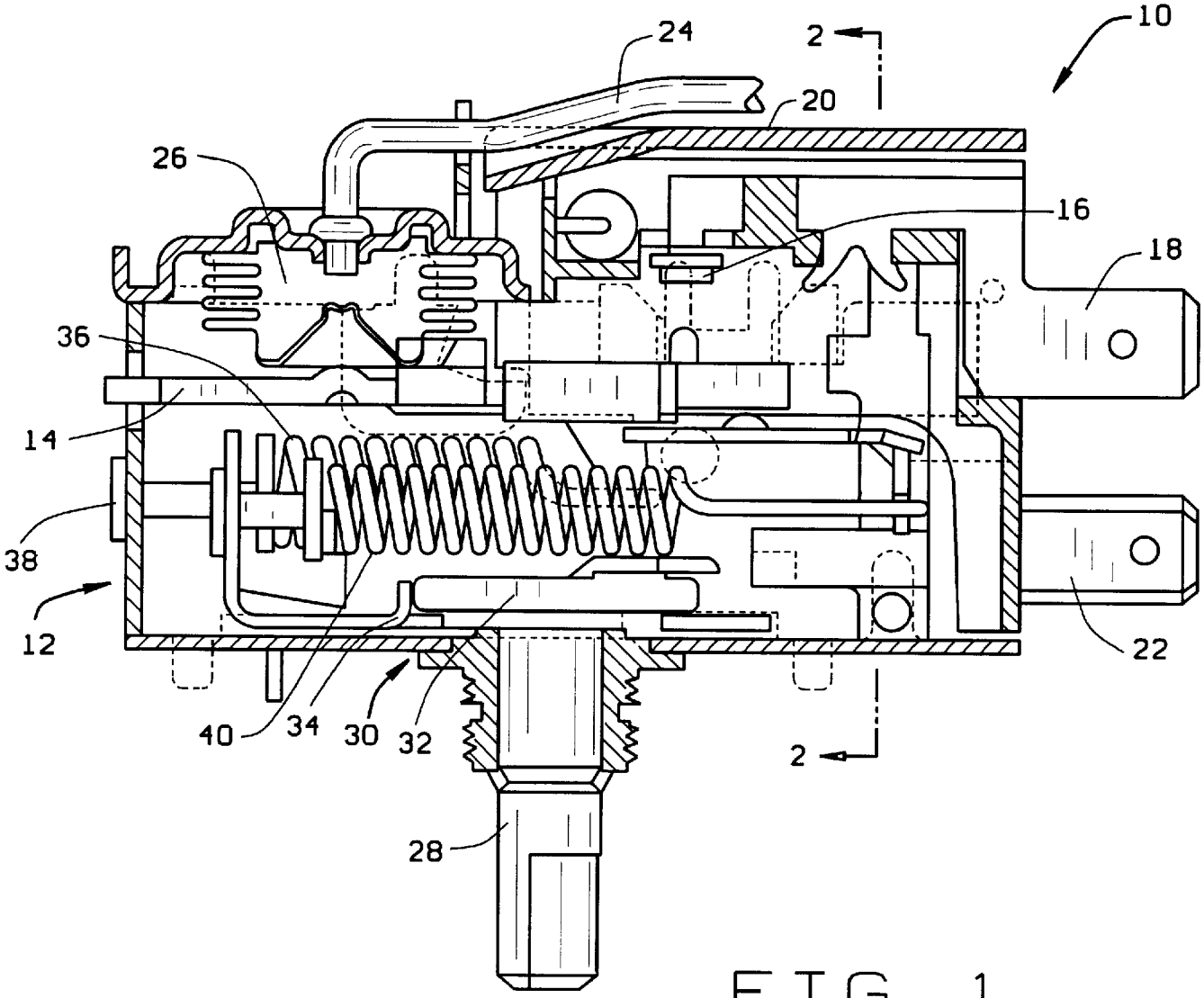
FIG. 1 is a cross-sectional view of a refrigerator thermostat.

FIG. 1 is a partial cross sectional view of a condition responsive electric switch, or thermostat 10. Thermostat 10 includes a housing 12, an actuator arm 14, a movable electrical contact (not shown in FIG. 1), and an adjustable auxiliary contact 16 for completing an auxiliary circuit (not shown) through an auxiliary terminal 18 extending through housing 12.

Housing 12 includes an insulated housing portion 20, a first terminal (not shown in FIG. 1), a second terminal (not shown in FIG. 1), and a pair of ground terminals 22 for plug-in connection to a main electric circuit, such as, for example, a power circuit for a refrigeration compressor (not shown). The power circuit is broken and completed through the first and second terminals by the operation of a bistable spring switch (not shown in FIG. 1).

Actuator arm 14 is pivotally mounted within housing 12 for a rocking movement that manipulates the bistable spring switch to engage or disengage the electrical contacts in response to environmental conditions outside housing 12, such as, for example, a temperature at a designated location or temperature reference point. A bellows 26 and capillary tube 24 are charged with an operating fluid, such as a refrigerant gas, that expands and contracts due to temperature changes at the reference point. As the operating fluid expands and contracts, bellows 26 move actuator arm 14, which transmits the movement of bellows 26 to the bistable spring switch to actuate the switch between circuit open and circuit closed positions.

A shaft 28 extends partially through housing 12 and is rotatable for adjustment of the temperature conditions that cause actuator arm 14 to cycle the completion of the main circuit, thereby turning elements connected to the circuit on and off.

In a particular embodiment for use in a refrigeration system, shaft 28 has an OFF position, a WARM position, and a COLD position. In the OFF position, the electrical contacts of the switch are forced apart and the switch is unresponsive to temperature changes in the evaporator tube. In an ON position, i.e., not in the OFF position, shaft 28 may be rotated to any desired setting between the WARM position and the COLD position to vary the temperature of the air in, for example, a refrigerator compartment, i.e., the reference point, by cycling a refrigeration compressor connected to the main circuit on and off.

A cam assembly 30 includes a cam 32 within housing 12 and connected to shaft 28, and a spring loaded cam follower 34 connected to actuator arm 14. Hence, a primary bias spring 36 connects cam follower 34 to actuator arm 14 and serves both to bias actuator arm 14 against movement and to keep cam follower 34 in contact with cam 32. A screw 38 allows primary bias spring 36 to be calibrated to preset factory specifications during manufacture of thermostat 10 so that actuator arm 14 will pivot appropriately at desired temperature ranges. A secondary spring 40 also biases actuator arm against movement.

Figure 2:
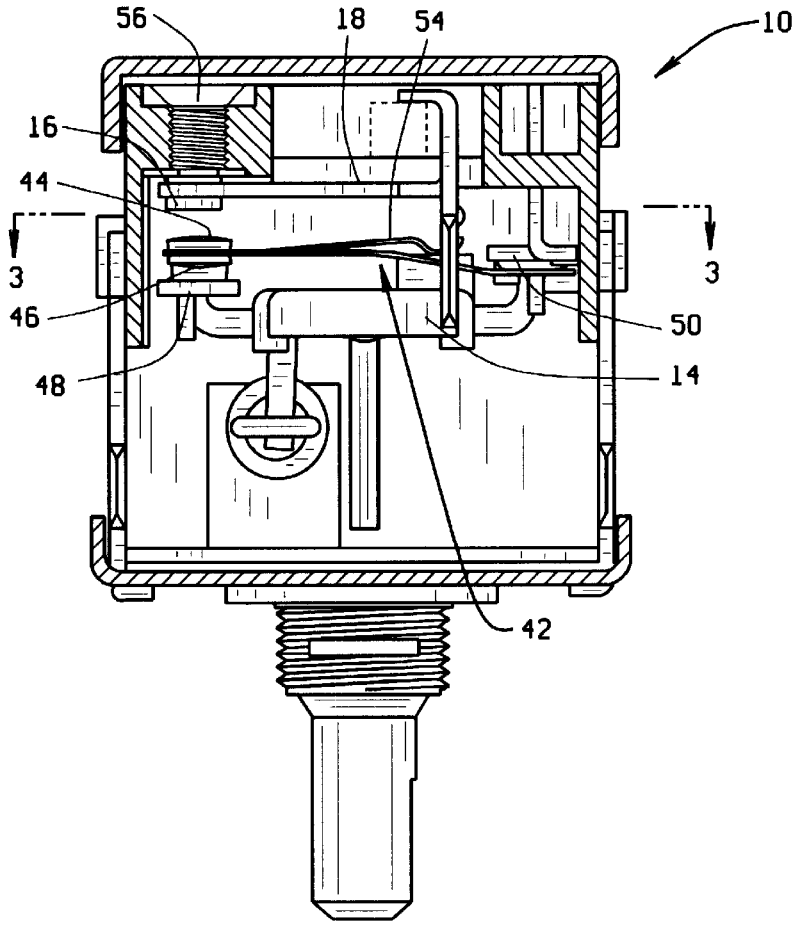
FIG. 2 is a cross-sectional view with parts removed along line 2—2 of FIG. 1.

FIG. 2 is a cross-sectional view of FIG. 1 including actuator arm 14 communicating with a bistable spring switch element 42. A movable contact 44 engages and disengages a stationary contact 46 to complete an electrical connection between a first terminal 48 and a second terminal 50. Movable contact 44 also engages and disengages auxiliary contact 16 located on auxiliary terminal 18 to complete an electrical connection through first terminal 48 and auxiliary terminal 18. A tongue 54 of bistable spring switch element 42 interfaces with actuator arm 14 and causes snap action movement, further explained below, of movable contact 44 as actuator arm 14 pivots in response to temperature changes at the temperature reference point.

The position of auxiliary contact 16 relative to stationary contact 46, and also relative to movable contact 44, is adjustable with an adjust screw 56 extending through housing 12. Adjust screw 56 contacts auxiliary terminal 18 and deflects auxiliary terminal 52 to vary the separation of auxiliary contact 16 and stationary contact 46. As the separation of contacts 16, 46 decreases, a lesser movement of actuator arm 14 is required to engage movable contact 44 and auxiliary contact 16, which corresponds to a lesser temperature change, or temperature differential, in the evaporator tube. In other words, the auxiliary circuit through thermostat 10 becomes more sensitive to changes in temperature of the temperature reference point as the separation between contacts 16, 46 becomes smaller.

In alternative embodiments, a round or polygonal adjustment member (not shown) is press fit into an aperture (not shown) through thermostat housing 12 and engages auxiliary terminal 18 for adjustment of the position of auxiliary contact 16 by pushing on the adjust member. In another alternative embodiment, the position of auxiliary contact 16 is adjustable by mechanically bending auxiliary terminal 18.

Figure 3:
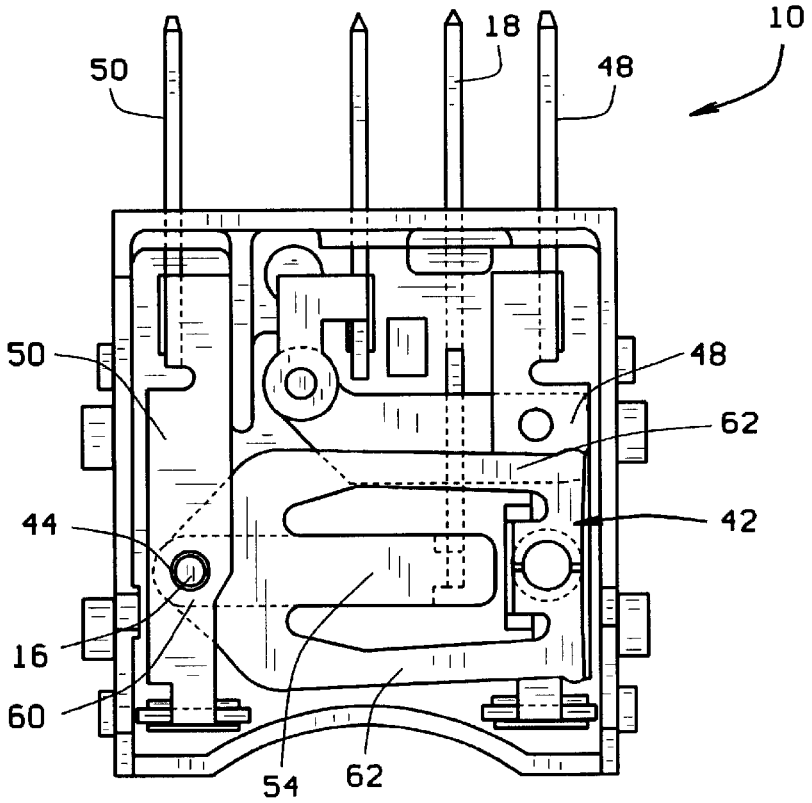
FIG. 3 is a cross sectional view with parts removed along line 3—3 of FIG. 2.

FIG. 3 illustrates bistable spring switch element 42 operated by actuator arm 14 (shown in FIGS. 1 and 2). Bistable spring switch element 42 selectively opens and closes an electrical circuit between first terminal 48 and second terminal 50. Bistable spring switch element 42 is fixedly connected to first terminal 48 and carries moveable contact 44 that is selectively engageable with stationary contact 46 (shown in FIG. 2) that is located on second terminal 50. Auxiliary terminal 18 is positioned between first terminal 48 and second terminal 50, and includes auxiliary contact 16 (shown in FIG. 2) for engagement with movable contact 44.

Bistable spring switch element 42 includes a head 60 on which movable contact 44 is mounted, and a pair of arms 62 extending outwardly from head 60. Tongue 54 extends outwardly from head 60 and is positioned between arms 62. As bellows 26 (shown in FIG. 1) expand and contract, actuator arm 14 (shown in FIGS. 1 and 2) engages and moves tongue 54 upward and downward. As the evaporator tube temperature rises, bellows 26 expand and cause actuator arm 14 to push tongue 54 upward so that bistable spring switch element 42 snaps into a convex configuration that engages movable contact 44 and stationary contact 46, completing an electrical circuit through first and second terminals 48, 50, respectively. As the evaporator tube temperature falls, tongue 54 is moved downward, and bistable spring switch element 42 snaps into a concave configuration that separates contacts 44, 46 and opens the circuit between first and second terminals 48, 50. When first and second terminals 48, 50 are connected to a main circuit (not shown) including, for example, a compressor (not shown), bistable spring switch element 42 therefore cycles the compressor on and off in response to the temperature of the evaporator tube.

As the temperature reference point temperature continues to fall, the concave curvature of bistable spring switch element 42 becomes more pronounced and movable contact 44 moves toward auxiliary contact 16. Eventually, movable contact 44 engages auxiliary contact 16 and completes a circuit through first terminal 48 and auxiliary terminal 18. When first terminal 48 and auxiliary terminal 18 are connected to an auxiliary circuit (not shown), including, for example, a heater element (not shown), bistable spring switch element 42 therefore cycles the heater element on and off to counteract unacceptably cool temperatures.

Of course, thermostat 10 may be used for temperature responsive control of elements other than compressors and heaters by electrically connecting alternative elements to first and second terminals 48, 50 and to the first and auxiliary terminals 48, 16 respectively. Also, bellows 26 (shown in FIG. 1) could be attached to actuator arm 14 in such a manner as to reverse the movement of the actuator arm in response to temperature changes at the temperature reference point, thereby cycling the connection of the auxiliary circuit on and off in response to designated temperature increases at the temperature reference point.

Figure 4:
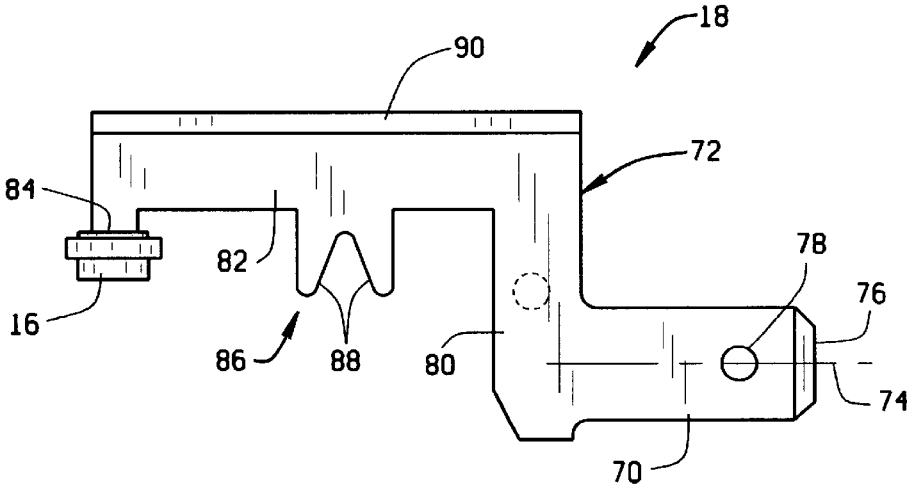
FIG. 4 is a front view of the auxiliary terminal shown in FIG. 1.

FIG. 4 is a front view of auxiliary terminal 18 including a blade portion 70, a connecting portion 72, and auxiliary contact 16 positioned above blade portion 70. Blade portion 70 extends along a first longitudinal axis 74 and includes a tapered leading edge 76 and an aperture 78. Planar connector portion 72 includes a first portion 80 that is substantially perpendicular to and extends away from first longitudinal axis 74, a second portion 82 that is substantially parallel to first longitudinal axis 74, and a third portion 84 substantially perpendicular to second portion 82 and extending toward first longitudinal axis 74. A bifurcated stake 86 extends from second portion 82 for connection to switch housing 12 (FIG. 1). Stake 86 is inserted through a housing aperture and forks 88 are separated from one another to hold auxiliary terminal 18 in position relative to housing 12 as shown in FIG. 1. A ledge 90 extends from and perpendicular to second portion 82 and supports said auxiliary terminal 18 inside housing 12, as also illustrated in FIG. 1.

Auxiliary terminal 18 is fabricated from brass and is integrally formed according to known methods. Alternatively, auxiliary terminal 18 could be made from other electrically conducting materials known in the art. In alternative embodiments, other connection mechanisms known in the art are used in lieu of stake 86 to connect auxiliary terminal to switch housing.

Figure 5:
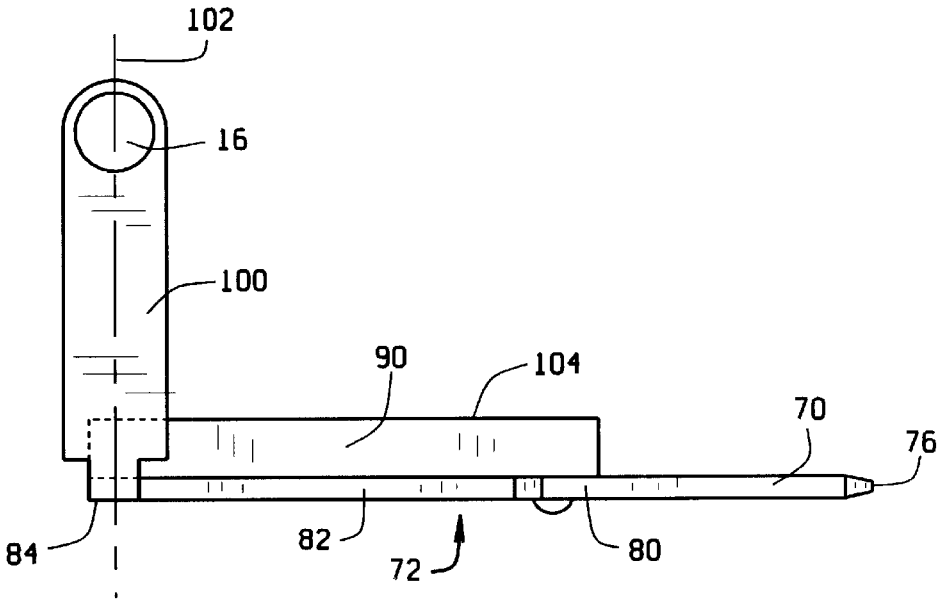
FIG. 5 is a bottom view of the auxiliary terminal shown in FIG. 1.

FIG. 5 is a bottom view of auxiliary terminal 18 illustrating coplanar blade portion 70 and connector portion first portion 80, second portion 82, and third portion 84, together with an arm portion 100 extending from connector second portion 82 and distancing auxiliary contact 16 from connector portion 72 along a second longitudinal axis 102. Second longitudinal axis 102 is substantially perpendicular to first longitudinal axis 74 that extends through blade portion 70 and blade portion beveled leading edge 76. Ledge 90 extends from connector portion 72, and includes a leading edge 104 that is generally parallel to first longitudinal axis 74.

Figure 6:
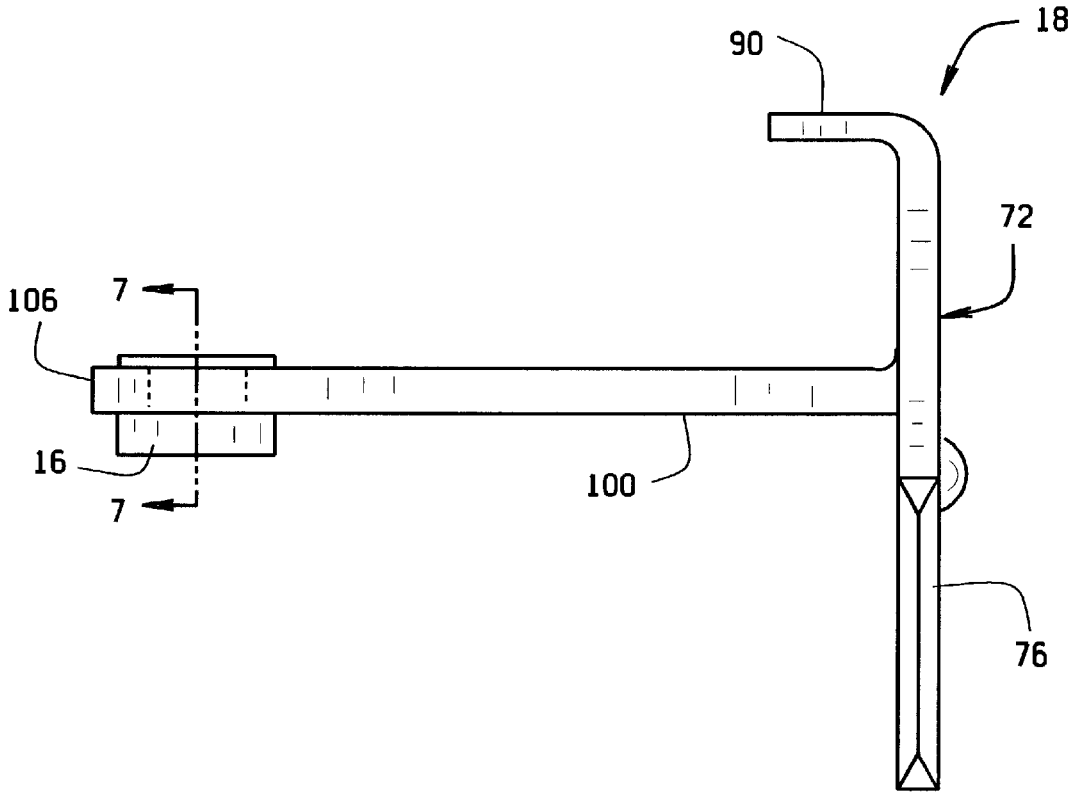
FIG. 6 is a side view of the auxiliary terminal shown in FIG. 1.

FIG. 6 is a side view of auxiliary terminal 18 including beveled blade portion leading edge 76, arm portion 100 extending transversely from connector portion 72, ledge 90 extending generally parallel to arm portion 100, and auxiliary contact 16 located on a distal end 106 of arm portion 100. Arm portion 100 extends as a cantilever beam from connector portion 72 and spans approximately the distance between first terminal 48 and second terminal 50 so that arm portion 100 generally extends above bimetal spring switch element tongue 54 (see FIG. 3) and positions auxiliary contact 16 in proximity with movable contact 44. When auxiliary contact 16 receives adjust screw 56 (shown in FIG. 2), arm portion 100 deflects to facilitate adjustment of auxiliary contact 16 position relative to stationary contact 46.

Figure 7:
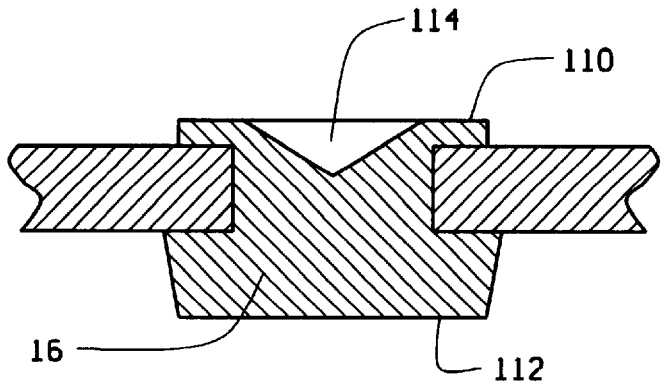
FIG. 7 is a cross sectional view along line 8—8 of FIG. 7.

FIG. 7 is a cross sectional view taken through auxiliary contact 16, and illustrating auxiliary contact first end 110 and second end 112. First end 110 includes a conical depressed surface 114 to accommodate a head (not shown in FIG. 7) of adjust screw 56 (see FIG. 2) and ensures engagement of adjust screw 56 (shown in FIG. 2) and auxiliary contact 16.

Thus, dual circuit temperature controlled switch is provided for automatic, temperature responsive control of both a main and an auxiliary circuit to cooperatively operate more than one electrical element to control the temperature of a desired reference point.

While the invention has been described in terms of various specific embodiments, those skilled in the art will recognize that the invention can be practiced with modification within the spirit and scope of the claims.

What is claimed is:

1. A condition responsive electric switch comprising:

a housing;

an actuator arm pivotally mounted within said housing, said arm pivoting in response to fluid communication with environmental conditions outside said housing;

a movable contact communicating with said actuating arm; and an adjustable auxiliary contact for engagement with said movable contact for opening and closing an auxiliary circuit in response to movement of said actuator arm, wherein said auxiliary contact comprises a first end and a second end, at least one of said first and second ends comprising a depressed surface.

2. A switch in accordance with claim 1 further comprising an auxiliary terminal connected to said auxiliary contact.

3. A switch in accordance with claim 2 further comprising first and second terminals, said movable contact opening and closing an electrical connection through said first terminal and said second terminal.

4. A switch in accordance with claim 3 wherein said movable contact opens and closes an auxiliary circuit through said first terminal and said auxiliary terminal.

5. A switch in accordance with claim 2 wherein said auxiliary terminal comprises a blade portion and an arm portion, said arm portion connected to said blade portion, said auxiliary contact connected to said arm portion.

6. A switch in accordance with claim 5 wherein said blade portion comprises a longitudinal axis and said arm portion comprises a longitudinal axis, said blade portion longitudinal axis transverse to said arm portion longitudinal axis.

7. A switch in accordance with claim 6 wherein said blade portion longitudinal axis and said arm portion longitudinal axis are substantially perpendicular.

8. A switch in accordance with claim 6 wherein said blade portion longitudinal axis and said arm portion longitudinal axis are vertically offset.

9. A switch in accordance with claim 5, said auxiliary terminal further comprising a connector portion connecting said blade portion and said arm portion.

10. A switch in accordance with claim 9 wherein said connector portion comprises a stake.

11. A switch in accordance with claim 9 wherein said connector portion comprises a ledge.

12. A switch in accordance with claim 11 wherein said arm portion comprises a longitudinal axis, said ledge extending parallel to said arm portion longitudinal axis.

13. A switch in accordance with claim 1 further comprising an adjust screw contacting said depressed section.

14. A condition responsive electric switch comprising:

a housing;

first and second terminals extending through said housing;

first and second electrical contacts within said housing and connected to said first and second terminals, at least one contact moveable between an open position breaking a first electrical circuit through said first and second terminals and a closed position completing an electrical circuit through said first and second terminals in response to fluid communication with environmental conditions outside said housing;

an actuator arm pivotally mounted within said housing;

a spring switch element within said housing for separating and engaging said first and second electrical contacts in response to movement of said actuator arm;

a third contact within said housing and positioned for engagement with said movable contact; said third contact comprising a first end and a second end, at least one of said first and second ends comprising a depressed surface, and wherein a position of said third contact is adjustable; and a third terminal extending through said housing and connected to said third contact for completing a second circuit through said first terminal and said third terminal in response to movement of said actuator arm.

15. A switch in accordance with claim 14 further comprising an adjust screw for adjusting said position of said third contact.

16. A switch in accordance with claim 14 wherein said third terminal comprises a blade portion and an arm portion, said arm portion connected to said blade portion, said third contact connected to said arm portion.

17. A switch in accordance with claim 16 wherein said blade portion comprises a longitudinal axis and said arm portion comprises a longitudinal axis, said blade portion longitudinal axis transverse to said arm portion longitudinal axis.

18. A switch in accordance with claim 17 wherein said blade portion longitudinal axis and said arm portion longitudinal axis are substantially perpendicular.

19. A switch in accordance with claim 17 wherein said blade portion longitudinal axis and said arm portion longitudinal axis are vertically offset.

20. A switch in accordance with claim 16, said auxiliary terminal further comprising a connector portion connecting said blade portion and said arm portion.

21. A switch in accordance with claim 20 wherein said connector portion comprises a stake.

22. A switch in accordance with claim 20 wherein said connector portion comprises a ledge.

23. A switch in accordance with claim 22 wherein said arm portion comprises a longitudinal axis, said ledge extending parallel to said arm portion longitudinal axis.

* * * * *

UNITED STATES PATENT AND TRADEMARK OFFICE

CERTIFICATE OF CORRECTION

PATENT NO. : 6,496,097 B2
DATED : December 17, 2002
INVENTOR(S) : Frank

It is certified that error appears in the above-identified patent and that said Letters Patent is hereby corrected as shown below:

Title page,
Item [57], ABSTRACT,
Line 4, delete “a auxiliary” and insert therefore -- an auxiliary --.
Line 7, delete “swings a” and insert therefore -- swings at a --.

Signed and Sealed this

Twenty-second Day of April, 2003

JAMES E. ROGAN
*Director of the United States Patent and Trademark Office*